US008210258B2

(12) United States Patent
O'Malley et al.

(10) Patent No.: US 8,210,258 B2
(45) Date of Patent: Jul. 3, 2012

(54) WIRELINE-ADJUSTABLE DOWNHOLE FLOW CONTROL DEVICES AND METHODS FOR USING SAME

(75) Inventors: Edward J. O'Malley, Houston, TX (US); Elmer R. Peterson, Porter, TX (US); Martin P. Coronado, Cypress, TX (US); Luis A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 282 days.

(21) Appl. No.: 12/645,273

(22) Filed: Dec. 22, 2009

(65) Prior Publication Data

US 2011/0146975 A1 Jun. 23, 2011

(51) Int. Cl.

| | |
|---|---|
| ***E21B 43/12*** | (2006.01) |
| ***E21B 47/00*** | (2006.01) |
| ***E21B 34/06*** | (2006.01) |
| ***E21B 34/14*** | (2006.01) |

(52) U.S. Cl. ..... 166/250.15; 166/250.01; 166/373; 166/66.7

(58) Field of Classification Search ..... 166/250.01, 166/250.15, 373, 66.6, 386, 53, 66.7
See application file for complete search history.

(56) References Cited

U.S. PATENT DOCUMENTS

| | | | | |
|---|---|---|---|---|
| 5,265,679 | A | 11/1993 | Coronado et al. | |
| 5,957,207 | A | 9/1999 | Schnatzmeyer | |
| 6,112,817 | A | 9/2000 | Voll et al. | |
| 6,220,357 | B1 | 4/2001 | Carmichael et al. | |
| 6,478,087 | B2 * | 11/2002 | Allen | 166/255.1 |
| 6,527,052 | B2 * | 3/2003 | Ringgenberg et al. | 166/336 |
| 6,973,974 | B2 | 12/2005 | McLoughlin et al. | |
| 7,055,598 | B2 | 6/2006 | Ross et al. | |
| 7,290,606 | B2 | 11/2007 | Coronado et al. | |
| 2002/0003038 | A1 * | 1/2002 | Bussear et al. | 166/66.6 |
| 2002/0189815 | A1 | 12/2002 | Johnson et al. | |
| 2003/0066652 | A1 * | 4/2003 | Stegemeier et al. | 166/373 |
| 2004/0094307 | A1 | 5/2004 | Daling et al. | |
| 2007/0246210 | A1 | 10/2007 | Richards | |
| 2007/0246212 | A1 | 10/2007 | Richards | |
| 2007/0246213 | A1 | 10/2007 | Hailey, Jr. | |
| 2007/0272408 | A1 | 11/2007 | Zazovsky et al. | |
| 2008/0041580 | A1 | 2/2008 | Freyer et al. | |
| 2008/0041581 | A1 | 2/2008 | Richards | |
| 2008/0041586 | A1 | 2/2008 | Eken | |
| 2008/0041588 | A1 | 2/2008 | Richards et al. | |
| 2008/0047709 | A1 | 2/2008 | Tremblay et al. | |
| 2008/0135255 | A1 | 6/2008 | Coronado et al. | |
| 2009/0065195 | A1 | 3/2009 | Chalker et al. | |

(Continued)

*Primary Examiner* — Cathleen Hutchins
(74) *Attorney, Agent, or Firm* — Cantor Colburn LLP

(57) ABSTRACT

A method of producing fluids from a wellbore that has therein n adjustable flow control device for controlling flow of fluid between a formation and the wellbore may include: providing a tool having a sensor configured to provide measurements relating to a downhole property of interest, wherein the tool is configured to adjust flow from the flow control device; conveying the tool into the wellbore; determining the property of interest using the tool; and adjusting the flow through the flow control device with the tool at least in part in response to the determined parameter of interest. An apparatus for controlling fluid flow between a formation and a wellbore, according to one embodiment may include: a tool configured to be conveyed into a wellbore that contains at least one sensor for estimating a property of interest downhole and a latching device configured to couple to a flow control device in the wellbore to alter flow of the fluid through the flow control device.

20 Claims, 7 Drawing Sheets

U.S. PATENT DOCUMENTS

| | | | |
|---|---|---|---|
| 2009/0095487 | A1 | 4/2009 | Xu et al. |
| 2009/0139728 | A1 | 6/2009 | Schrader et al. |
| 2009/0151925 | A1 | 6/2009 | Richards et al. |
| 2009/0205834 | A1 | 8/2009 | Garcia et al. |
| 2009/0236102 | A1 | 9/2009 | Guest et al. |
| 2009/0301726 | A1 | 12/2009 | Coronado |
| 2011/0017469 | A1 | 1/2011 | Malone |

* cited by examiner

WIRELINE-ADJUSTABLE DOWNHOLE FLOW CONTROL DEVICES AND METHODS FOR USING SAME

BACKGROUND OF THE DISCLOSURE

1. Field of the Disclosure

The disclosure relates generally to apparatus and methods for control of fluid flow from subterranean formations into a production string in a wellbore.

2. Description of the Related Art

Hydrocarbons such as oil and gas are recovered from a subterranean formation using a well or wellbore drilled into the formation. In some cases the wellbore is completed by placing a casing along the wellbore length and perforating the casing adjacent each production zone (hydrocarbon bearing zone) to extract fluids (such as oil and gas) from the associated a production zone. In other cases, the wellbore may be open hole, i.e. no casing. One or more inflow control devices are placed in the wellbore to control the flow of fluids into the wellbore. These flow control devices and production zones are generally separated by packers installed between them. Fluid from each production zone entering the wellbore is drawn into a tubular that runs to the surface. It is desirable to have a substantially even flow of fluid along the production zone. It is also desirable adjust the flow control devices so that unwanted fluids, such as water or gas, are not produced or produced in reduced amounts from the affected zones.

Horizontal wellbores often are completed with several inflow control devices placed spaced apart along the length of the horizontal section. Formation fluid often contains a layer of oil, a layer of water below the oil and a layer of gas above the oil. The horizontal wellbore is typically placed above the water layer. The boundary layers of oil, water and gas may not be even along the entire length of the horizontal well. Also, certain properties of the formation, such as porosity and permeability, may not be the same along the length of the well. Therefore, oil between the formation and the wellbore may not flow evenly through the various inflow control devices. For production wellbores, it is desirable to have a relatively even flow of the oil into the wellbore and also to inhibit the flow of water and gas through each inflow control device. Passive inflow control devices are commonly used to control flow into the wellbore. Such inflow control devices are set at the surface for a specific flow rate and then installed in the production string, which is then conveyed and installed in the wellbore. Such pre-set passive flow control devices are not designed or configured for downhole adjustments. After the well has been in production, a wireline tool is periodically conveyed into the production string to determine one or more properties of the fluid, wellbore or the formation. If it is determined that the flow of the fluid from particular flow control devices needs adjustment, such as because a particular zone has started producing an undesirable fluid, such as water or gas, or the inflow control device has clogged or deteriorated and the current setting is not adequate, etc. To change the flow rate through such passive inflow control devices, the production string is pulled out to adjust or replace the flow control devices. Such methods are very expensive and time consuming.

The disclosure herein provides improved apparatus and methods for determining one or more properties of interest downhole and adjusting flow control devices without removing the production string from the wellbore.

SUMMARY

In one aspect, a method of producing fluids from a wellbore that includes a production zone having a flow control device for controlling flow of fluid between a formation and the wellbore, the method in one embodiment may include: providing a tool having a sensor configured to provide measurements relating to a downhole property of interest, wherein the tool is configured to adjust flow from the flow control device; conveying the tool into the wellbore; and determining the parameter of interest using the tool; adjusting the flow through the flow control device with the tool at least in part in response to the determined parameter of interest.

In another embodiment, the method of controlling fluid from a formation may include: placing a flow control device at a selected location in the wellbore, the flow control device including a flow region and a setting device for adjusting the flow of the fluid through the flow region; conveying a tool into the wellbore, the tool being configured to move inside the flow control device, the tool including (i) a sensor configured to provide measurements relating to a downhole property of interest, and (ii) a latching device configured to couple to the setting device of the flow control device; determining the property of interest using measurements taken by the sensor in the wellbore; and coupling the latching device in the tool to the setting device in the flow control device and moving the setting device to adjust flow through the flow control device in response to the determined value of the parameter of interest during a single trip of the tool in the wellbore.

In yet another aspect, an apparatus for controlling fluid flow between a formation and a wellbore is provided, which apparatus, according to one embodiment, may include: a tool configured to be conveyed into a wellbore, the tool including; at least one sensor for estimating a property of interest downhole; and a latching device configured to couple to a flow control device in the wellbore to alter flow of the fluid through the flow control device.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters designate like or similar elements throughout the several figures of the drawing, and wherein.

DETAILED DESCRIPTION OF THE DISCLOSURE

The present disclosure relates to apparatus and methods for controlling flow of formation fluids in a well. The present disclosure provides certain exemplary drawings to describe certain embodiments of the apparatus and methods that are to be considered exemplification of the principles described herein and are not intended to limit the concepts and disclosure to the illustrated and described embodiments.

Figure 1:
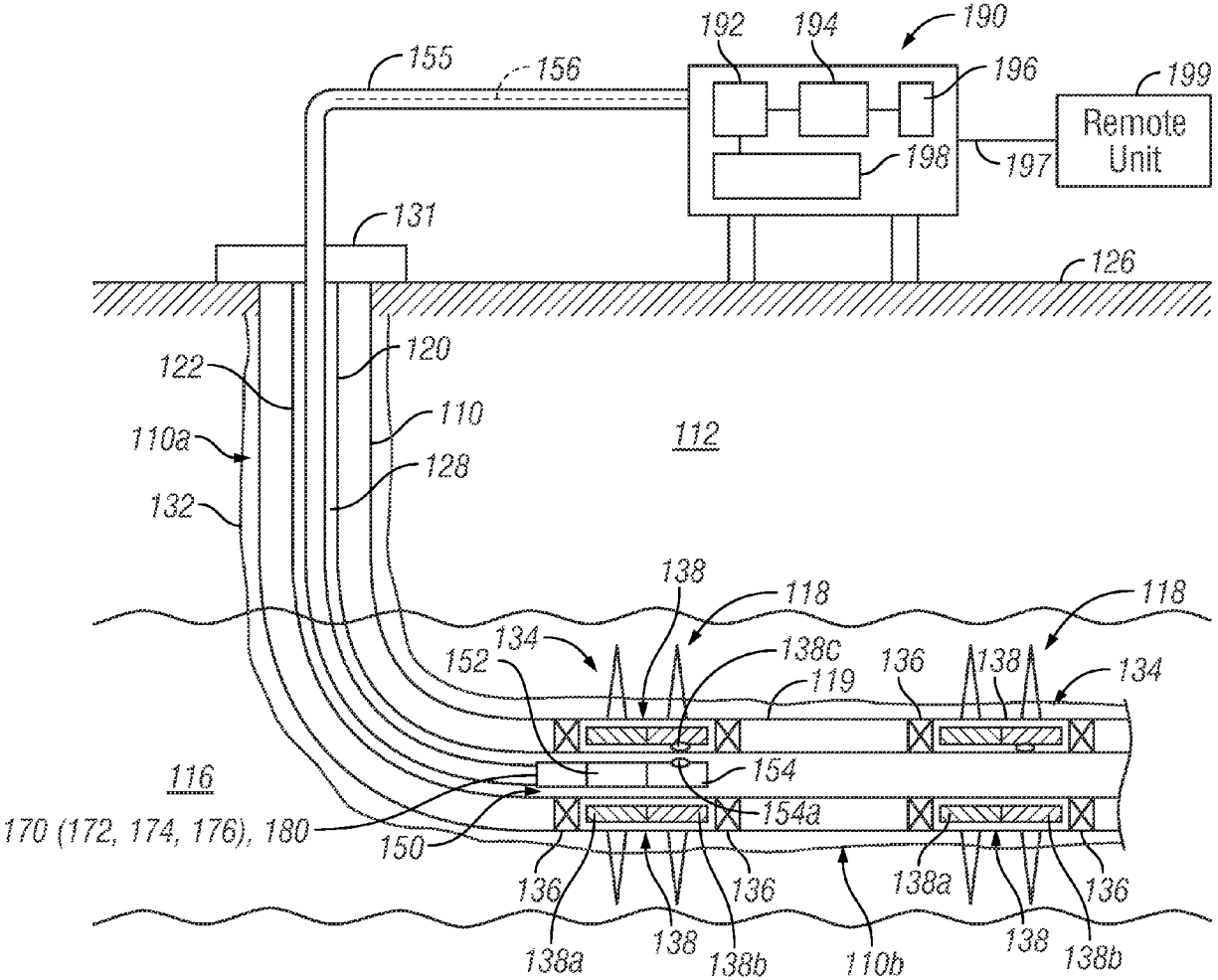
FIG. 1 is a schematic elevation view of an exemplary multi-zone wellbore system that has a production string installed therein, which production string includes one or more downhole-adjustable inflow control devices made according to an embodiment of the disclosure and a tool configured to determine a property of interest and adjust the flow through the inflow control devices.

FIG. 1 is a schematic diagram of an exemplary production wellbore system 100 that includes a wellbore 110 drilled through an earth formation 112 and into a production zone or reservoir 116. The wellbore 110 is shown lined with a casing 113 having a number of perforations 118 that penetrate and extend into the formations production zone 116 so that production fluids may flow from the production zone 116 into the wellbore 110. The exemplary wellbore 110 is shown to include a vertical section 110*a* and a substantially horizontal section 110*b*. The wellbore 110 includes a production string (or production assembly) 120 that includes a tubing (also referred to as the base pipe) 122 that extends downwardly from a wellhead 124 at the surface 126. The production string 120 defines an internal axial bore 128 along its length. An annulus 130 is defined between the production string 120 and the wellbore casing 113. The production string 120 is shown to include a generally horizontal portion 132 that extends along the deviated leg or section 110*b* of the wellbore 110. Production devices 134 are positioned at selected locations along the production string 120. Optionally, each production device 134 may be isolated within the wellbore 110 by a pair of packer devices 136. Although only two production devices 134 are shown along the horizontal portion 132, any number of such production devices 134 may be arranged along the horizontal portion 132.

Each production device 134 includes a downhole-adjustable flow control device 138 made according to one embodiment of the disclosure to govern one or more aspects of flow of one or more fluids from the production zones into the production string 120. The downhole-adjustable flow control device 138 may have a number of alternative structural features that provide selective operation and controlled fluid flow therethrough. In one embodiment, the downhole-adjustable flow control device 138 is adjustable by compliant tool or device conveyed from the surface. In another aspect, the downhole-adjustable flow control devices 138 are passive flow control devices (i.e., devices that are adjustable from the surface. In another aspect, each flow control device 138 may include a fluid control device (such as an inflow control device) 138*a* having a flow-through section or region and a setting device or tool 138*b* configured to adjust the flow through region when it is operated by tool from inside the flow control device. As used herein, the term "fluid" or "fluids" includes liquids, gases, hydrocarbons, multi-phase fluids, mixtures of two of more fluids, water and fluids injected from the surface, such as water. Additionally, references to water should be construed to also include water-based fluids; e.g., brine or salt water.

FIG. 1 further shows a tool 150 conveyed into the wellbore from the surface location via a suitable conveying member 155, such as a wireline or a tubular (such as a slick line or a coiled tubing). The tool 150 included one or more sensors 152 for providing measurements relating to one or more properties or parameters of interest and a latching device 154 for adjusting the flow from the flow control device 138. The property of interest may include any desired property, including, but not limited to, flow rate, pressure, temperature, and water or gas content in the fluid. Any suitable sensor may be used to determine the properties of interest, including, but not limited to a flow meter, pressure sensor, temperature sensor, resistivity sensor, acoustic sensor, and nuclear magnetic resonance sensor. Such sensors are known in the art and are thus not described in detail herein. The tool 150 may further include a controller or control unit 170 that includes a processor 172, such as a microprocessor, a memory or data storage device 174, such as a solid state memory, programs and algorithms 176 accessible to the processor 170 for executing programmed instructions. A telemetry unit 180 provides two-way communication between the downhole tool 150 and a surface controller or control unit 190 via a communication link 156. Power to the downhole tool is provided via a suitable cable in the conveying member 155. The surface controller may be a computer-based unit and may include a processor 192, a data storage device 194 and programmed instruction, models and algorithms 196 accessible to the processor. Other peripherals, such as data entry device, display device etc. 198 may be utilized for operating the controller unit 190. The controller 190 may communicate with a remote unit or satellite unit 199, such as placed at an office.

The latching device 154 may be any device configured to be move inside the flow control device 138 to couple to the setting device or member 138*b* of the flow control device 138. In one aspect, the latching device 154 may include a coupling element 154*a* configured to couple to a coupling element 138*c* of the setting device 138*b*. The latching device 154 may be moved in the flow control device 138 to move the coupling element 138*c* to adjust the flow through the flow control device 138. Certain exemplary flow control devices and tools are described below in reference to FIGS. 2-6. It should be noted that any downhole-adjustable flow control device and any suitable conveyable tool configured to adjust the downhole-adjustable device may be used for controlling flow of the fluid through the flow control device for the purposes of this disclosure.

In operation, the tool 150 is conveyed into the base pipe 122 and by the conveying member 155 and located proximate a flow control device 138. Surface equipment, such as depth locators and downhole sensors 152, such as accelerometers, magnetometers, etc. may be utilized to locate the tool 150 at the desired well depth. The sensors 152 are then activated to determine one or more properties (or parameters) of interest, such a flow rate, water cut, pressure, oil/water ratio, gas/oil ratio, presence of corrosion or asphaltene, water breakthrough, quality of cement bond, health of device or a component in the well, etc. The controllers 170/190 process the sensor data and provide information about one or more desired properties of interest in-situ (i.e., in real time). If the one or more parameters do not meet a selected criteria, such as water production is above a desired flow rate or volume, the operator or the system 100 positions the latching device or tool 154 and causes it to couple to the setting device 138*b*. The tool is then operated or maneuvered to operate the setting device to adjust the flow of the fluid through the flow control device 138 to a desired level. The above procedure may be utilized to determine a property of interest for each flow control devices and adjusted accordingly, without tripping the tool 150 from the wellbore. Thus, the system 100 enables determination of any number of properties downhole and setting of the one or more flow control devices without tripping the tool from the wellbore.

Figure 2:
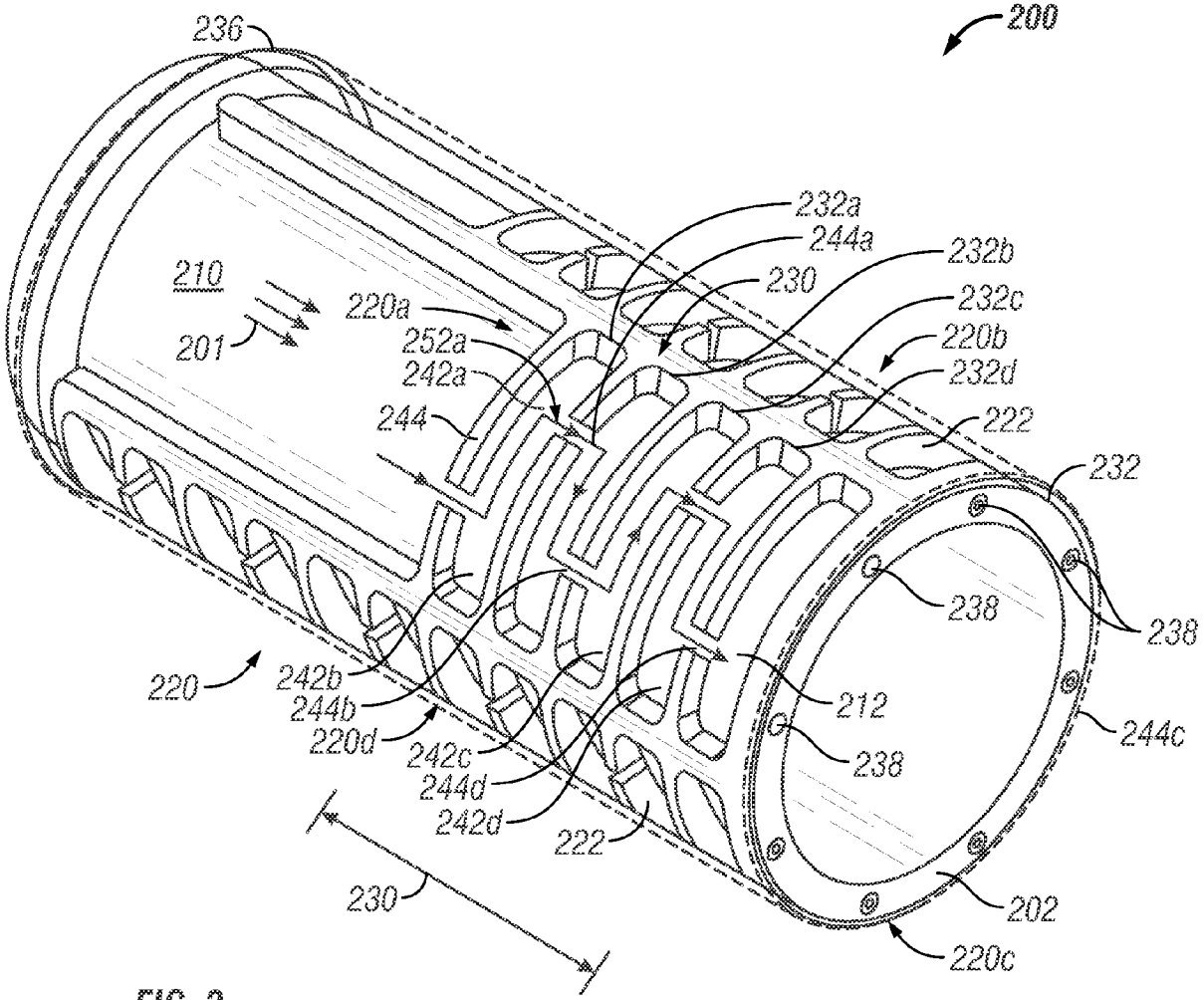
FIG. 2 shows an isometric view of a portion of passive inflow control member made according to one embodiment the disclosure.

FIG. 2 shows an isometric view of an embodiment of a portion of an exemplary multi-channel inflow control device 200 that may be used in the drill string and wellbore described herein. The inflow control device 200 may be included in a downhole-adjustable flow control device 138 for controlling the flow of fluids from a reservoir into a production string. The production device 134 may include a filtration device for reducing the amount and size of particulates entrained in the fluids and the inflow control device 200 that controls the overall drainage rate of the formation fluid into the wellbore. As depicted, the inflow control device 200 is shown to include a number of structural flow sections 220*a*, 220*b*, 220*c* and 220*d* formed around a tubular member 202, each such section defining a flow channel or flow path. Each section may be configured to create a predetermined pressure drop to control a flow rate of the production fluid from the formation into the wellbore tubing. One or more of these flow paths or sections may be occluded or independent (not in hydraulic communication with another section) in order to provide a selected or specified pressure drop across such sections. Fluid flow through a particular section may be controlled by closing ports 238 provided for the selected flow section.

As discussed below, a tubular member may adjoin the ports and thereby expose one or more selected ports, depending on parameters and conditions of the surrounding formation. As depicted, the total pressure drop across the inflow control device 200 is the sum of the pressure drops created by each active section. Structural flow sections 220*a*-220*d* may also be referred to as flow channels or flow-through regions. To simplify description of the inflow control device 200, the flow control through each channel is described in reference to channel 220*a*. Channel 220*a* is shown to include an inflow region 210 and an outflow region or area 212. Formation fluid enters the channel 220*a* into the inflow region 210 and exits the channel via outflow region 212. Channel 220*a* creates a pressure drop by channeling the flowing fluid through a flow-through region 230, which may include one or more flow stages or conduits, such as stages 232*a*, 232*b*, 232*c* and 232*d*. Each section may include any desired number of stages. Also, in aspects, each channel in the inflow control device 200 may include a different number of stages. In another aspect, each channel or stage may be configured to provide an independent flow path between the inflow region and the outflow region. Some or all of channels 220*a*-220*d* may be substantially hydraulically isolated from one another. That is, the flow across the channels and through the device 200 may be considered in parallel rather than in series. Thus, a production device 134 may enable flow across a selected channel while partially or totally blocking flow in the other channels. The inflow control device 200 blocks one or more channels without substantially affecting the flow across another channel. It should be understood that the term "parallel" is used in the functional sense rather than to suggest a particular structure or physical configuration.

Still referring to FIG. 2, there are shown further details of the multi-channel flow member 200 which creates a pressure drop by conveying the in-flowing fluid through one or more of the plurality of channels 220*a*-220*d*. Each of the channels 220*a*-220*d* may be formed along a wall of a base tubular or mandrel 202 and include structural features configured to control flow in a predetermined manner. While not required, the channels 220*a*-220*d* may be aligned in a parallel fashion and longitudinally along the long axis of the mandrel 202. Each channel may have one end in fluid communication with the wellbore tubular flow bore (shown in FIGS. 3-8) and a second end in fluid communication with the annular space or annulus separating the flow control device 200 and the formation. Generally, channels 220*a*-220*d* may be separated from one another, for example in the region between their respective inflow and outflow regions.

In embodiments, the channel 220*a* may be arranged as a maze or labyrinth structure that forms a tortuous or circuitous flow path for the fluid flowing therethrough. In one embodiment, each stage 232*a*-232*d* of channel 222*a* may respectively include a chamber 242*a*-242*d*. Openings 244*a*-244*d* hydraulically connect chambers 242*a*-242*d* in a serial fashion. In the exemplary configuration of channel 220*a*, formation fluid enters into the inflow region 210 and discharges into the first chamber 242*a* via port or opening 244*a*. The fluid then travels along a tortuous path 252*a* and discharges into the second chamber 242*b* via port 244*b* and so on. Each of the ports 244*a*-244*d* exhibit a certain pressure drop across the port that is function of the configuration of the chambers on each side of the port, the offset between the ports associated therewith and the size of each port. The stage configuration and structure within determines the tortuosity and friction of the fluid flow in each particular chamber, as described herein. Different stages in a particular channel may be configured to provide different pressure drops. The chambers may be configured in any desired configuration based on the principles, methods and other embodiments described herein. In embodiments, the multi-channel flow member 200 may provide a plurality of flow paths from the formation into the tubular.

As discussed below, a downhole-adjustable flow control device may be configured to enable adjustment of the flow path through the multi-channel flow member, thereby customizing the device based on formation and fluid flow characteristics. The channel or flow path may be selected based on formation fluid content or other measured parameters. In one aspect, each stage in the inflow control device 200 may have same physical dimensions. In another aspect, the radial distance, port offset and port size may be chosen to provide a desired tortuosity so that the pressure drop will be a function of the fluid viscosity or density. In an embodiment, a multi-channel flow member may exhibit relatively high percentage pressure drop change for low viscosity fluid (up to about 10 cP) and a substantially constant pressure drop for fluids in relatively higher viscosity range (from about 10 cP to 180 cP). Although the inflow control device 200 is described as a multi-channel device, the inflow control device used in a downhole-adjustable flow control device may include any suitable device, including, but not limited to, orifice-type device, helical device and a hybrid device.

Figure 3A:
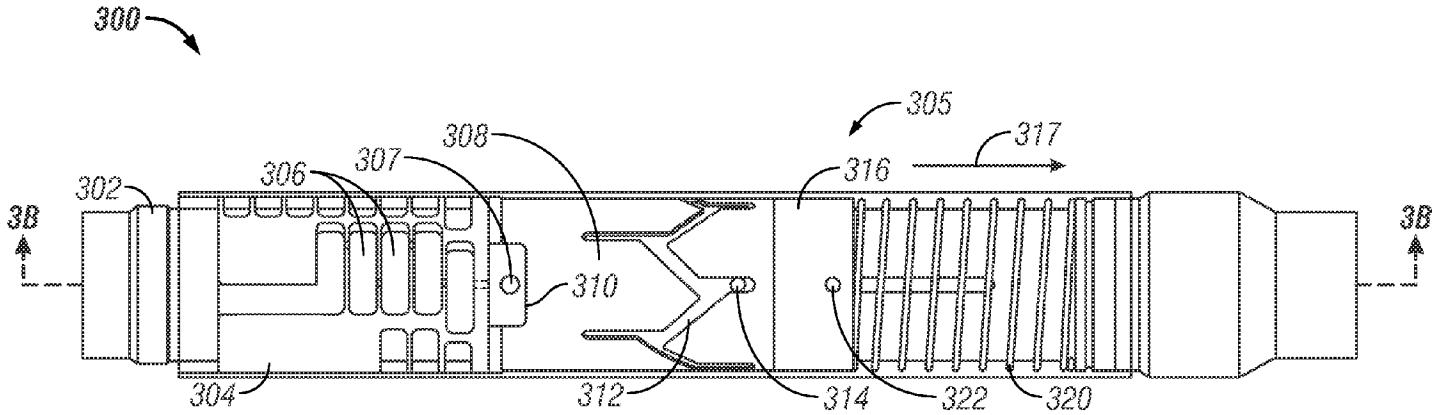
FIGS. 3A and 3B show a side view and sectional view respectively of a an adjustable flow control device in a first position according to one embodiment the disclosure.
Figure 3B:
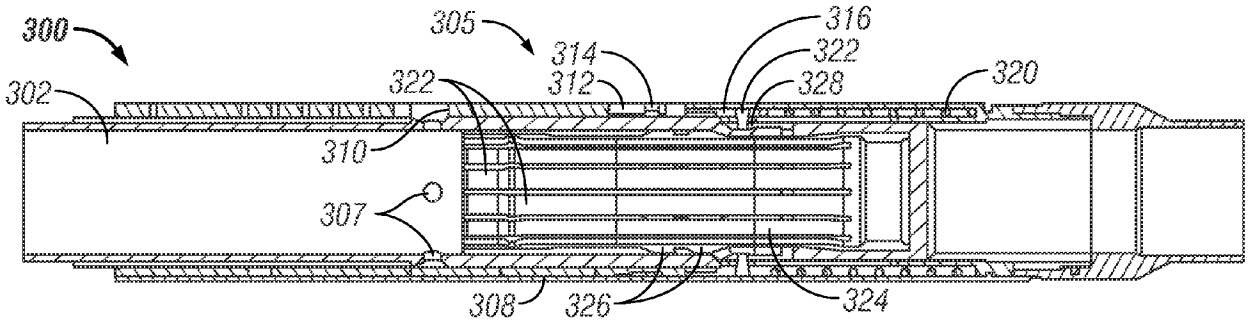

FIG. 3A is an isometric view of a downhole-adjustable flow control device 300 over a tubular member 302 according to one embodiment of the disclosure. FIG. 3B is a sectional view of the tubular 302 and adjustable flow control device 302. FIGS. 3A and 3B depict the adjustable flow control device 300 in a first position, which position for example may be set before deploying the flow control device 300 in the wellbore. The flow control device 300 is shown to include a multi-channel flow member 304 (also referred to inflow control device) and setting device 305. The first position of the setting device 305 corresponds to a selected channel of the multi-channel flow member 304. In an aspect, the multi-channel flow member 304 includes a plurality of flow channels, wherein each of the channels has a different flow resistance. In one embodiment the flow resistance for each channel may be configured to restrict a flow of a selected fluid, such as gas or water, into the tubular 302. As depicted, the multi-channel flow member 304 is configured to enable fluid flow through a channel that includes a series of stages 306, a flow port 307 and tubular 302. In aspects, the flow port 307 is located on a grooved portion 309 of the tubular 302, thereby enabling fluid flow from all ports 307, whether covered or uncovered by rotationally indexed member 308. In an aspect, four flow ports are located circumferentially, at 90 degrees relative to one another, around the grooved portion 309. Rotationally indexed member 308 includes a recessed portion 310 which exposes the flow port 307. The rotationally indexed member 308 includes a track 312 (also referred to as a J-slot or guide track) and a pin 314 (also referred to as a J-pin or guide pin) that control the rotational movement of the rotationally indexed member 308. In an aspect, there may be a plurality of pins 314 positioned with the track 312 to ensure stability during movement of the rotationally indexed member 308. In aspects, the track 312 is a patterned opening in the member that enables rotational and axial movement to adjust flow of fluid through the flow control device 302. In an embodiment, axial movement of components located inside of the tubular 302 may adjust the rotationally indexed member 308 to cause fluid flow through a selected channel of the multi-channel flow member 304.

The setting device 305 includes the rotationally indexed member 308, biasing member 320 and guide sleeve 316, each located outside of tubular 302. The guide sleeve 316 is coupled to the rotationally indexed member 308, which enables axial movement 317 of the tubular 302 and sleeve 316, while allowing independent rotational movement of the components. The guide sleeve 316 is also coupled to biasing member 320, such as a spring, that resists axial movement 317 when compressed. In an aspect, the biasing member 320 is fixedly secured to the tubular 302 on the end opposite the guide sleeve. In the depicted embodiment, the guide sleeve 316 is coupled to a guide pin 322 located in a slot. The guide pin 322 controls the axial range of motion of the guide sleeve 316 and the biasing member 320. An inner member (also referred to as a coupling member, a latching device or coupling tool), such as a collet 324, is located within the tubular 300 and includes protrusions 326 configured to selectively engage a shifting sleeve 328 that is a part of or coupled to the guide sleeve 316. The shifting sleeve 328 may also be referred to as a coupling member. As discussed below in FIGS. 4A and 4B, the protrusions 326 may engage the shifting sleeve 328 when the collet 324 moves axially in direction 317 within the tubular 300. The collet 324 may be any suitable member or tool configured to move axially within the tubular 300 and cause movement of the adjustable flow control device 302. The collet 324 includes axial members 332 separated by slots, wherein the axial members 332 are configured to bias or press away from the tubular axis and against the inner surface of the tubular 302. Accordingly, a wireline tool or coiled tubing may be used to move the collet 324 axially 317 within the tubular 302. The collet 324 may selectively engage and disengage to components within the tubular 302 to cause movement of the rotationally indexed member 308 and other components of the adjustable flow control device 300.

Figure 4A:
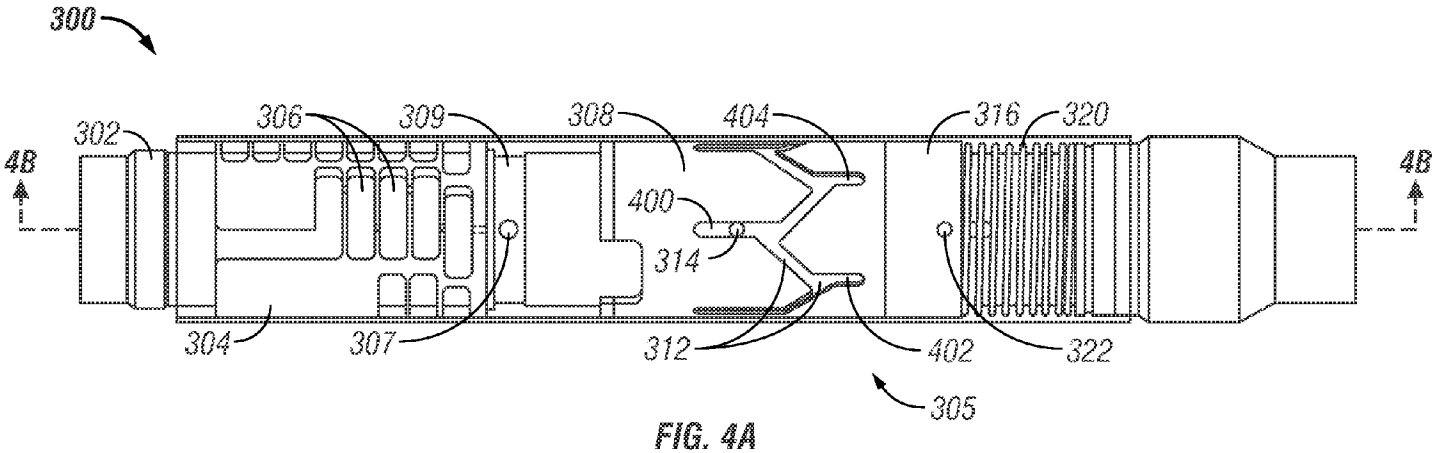
FIGS. 4A and 4B show a side view and sectional view respectively of the adjustable flow control device of FIGS. 3A and 3B in a second position according to one embodiment the disclosure.
Figure 4B:
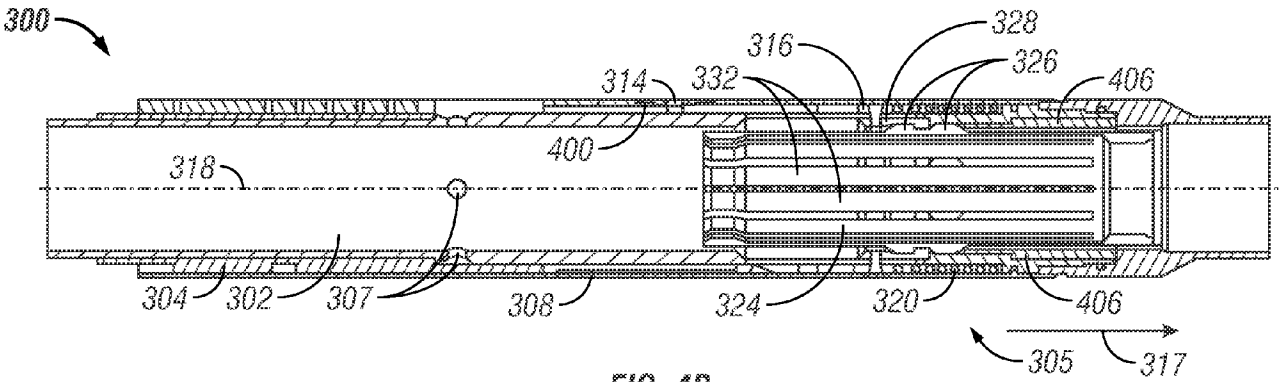

FIGS. 4A and 4B show a side view and a sectional view, respectively, of the tubular 302 and adjustable flow control device 300 in transition between channel flow positions. In aspects, the adjustable flow control device 300 may have any number of flow positions. As depicted, the adjustable flow control device 300 is in transition between the position in FIGS. 3A and 3B and the position in FIGS. 5A and 5B. In an aspect, a wireline tool or slickline tool may be used to moves the collet 324 in direction 317, wherein the collet 324 engages the shifting sleeve 328. Upon engaging the inner portion the shifting sleeve 328, the collet 324 causes the biasing member 320 to compress and the rotationally indexed member 308 to move in the direction 317. As the rotationally indexed member 308 moves in direction 330, the track 312 moves about pin 314 to cause the member to move rotationally. As depicted, the pin is in position 400 of the track 312 and the rotationally indexed member 308 is in transition between the first position and the second position, where the pin 314 is located in positions 402 and 404, respectively. The collet protrusions 326 may remain engaged with the shifting sleeve 328 until the protrusions 326 are pressed axially (318) and inward, such as by a release sleeve 406 located on the inside of the tubular 300.

Figure 5A:
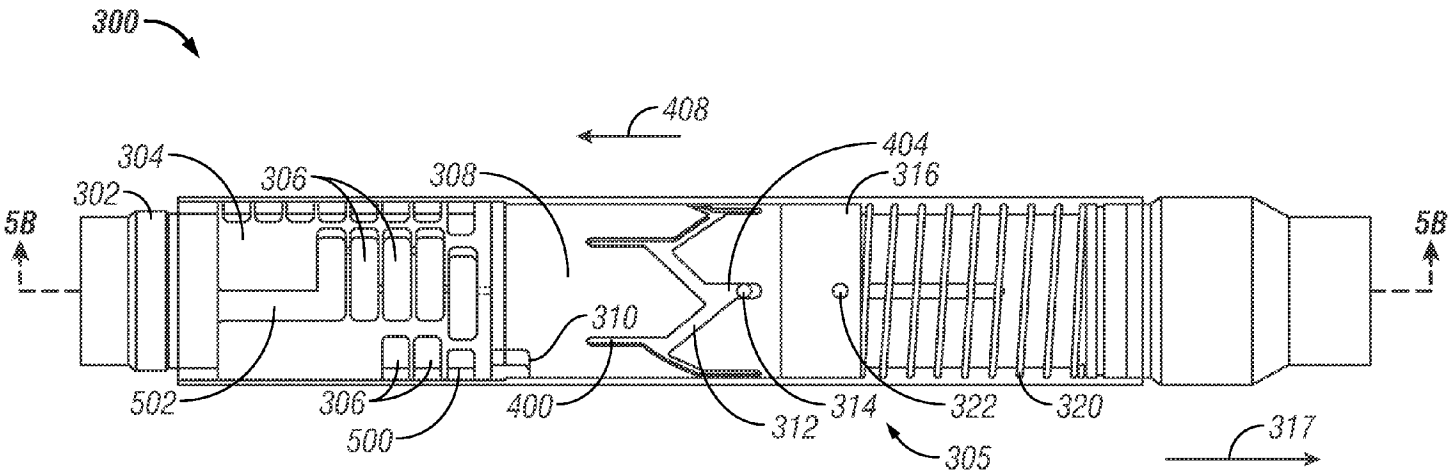
FIGS. 5A and 5B show a side view and sectional view respectively of the adjustable flow control device of FIGS. 3A-4B in a third position according to one embodiment the disclosure.
Figure 5B:
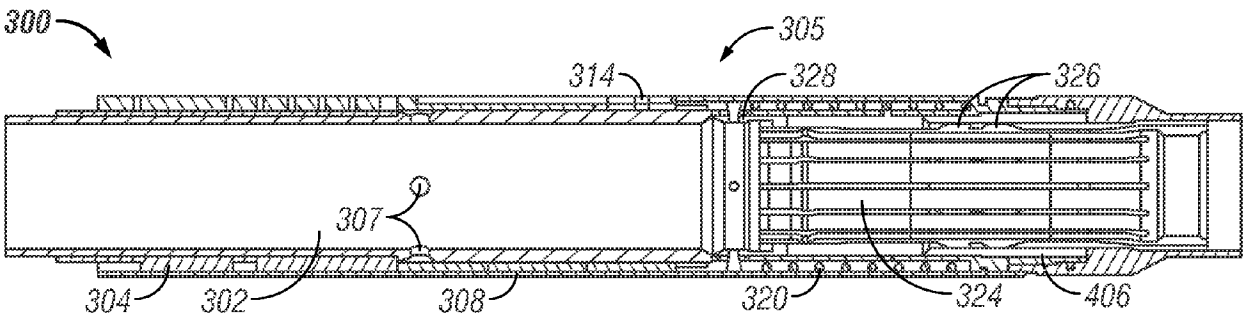

After releasing the protrusions 326 from shifting sleeve 328, the wireline tool continues to move the collet 324 downhole in the direction 330. Releasing the collet 324 causes expansion of the biasing member 320, causing the rotationally indexed member 308 and guide sleeve 316 to move in direction 408 in to the second position. The second position causes fluid flow through a second channel of the multi-channel flow member 304 while the pin 314 is in position 404 of the track 312. FIGS. 5A and 5B show a side view and sectional view respectively of the adjustable flow control device 300 in the second position. As depicted, the adjustable flow control device 300 enables fluid flow through the channel 500 of the multi-channel flow control member in the second position. Accordingly, the rotationally indexed member 308 is rotated to prevent fluid flow through other flow channels, including channel 502. The biasing member 320 is fully expanded, thereby pressing the guide pin 322 to a limit of the pin slot. As the collet 324 moves in direction 330 and releases the shifting sleeve 328, the pin 314 of the rotationally indexed member 308 moves into position 404 of track 312. The recessed portion 310 of the member 308 is then aligned to enable fluid flow from the channel 500 into the flow port 307.

FIGS. 3A through 5B show the movement of the adjustable flow control device 300 between two positions, wherein each position causes the formation fluid to flow through a different channel of the multi-channel flow member 304 and into the tubular 302. In aspects, the multi-channel flow member 304 includes a plurality of channels configured to enable selected fluids to flow into the tubular 302 while restricting flow of other fluids. A wireline tool or other suitable device may be used to move the inner member or collet 324 within the tubular 302 to cause adjustment of the adjustable flow control device 302. The process shown in FIGS. 3A through 5B may be repeated as many times as desired to set the adjustable flow control device 300 to a selected position.

Figure 6A:
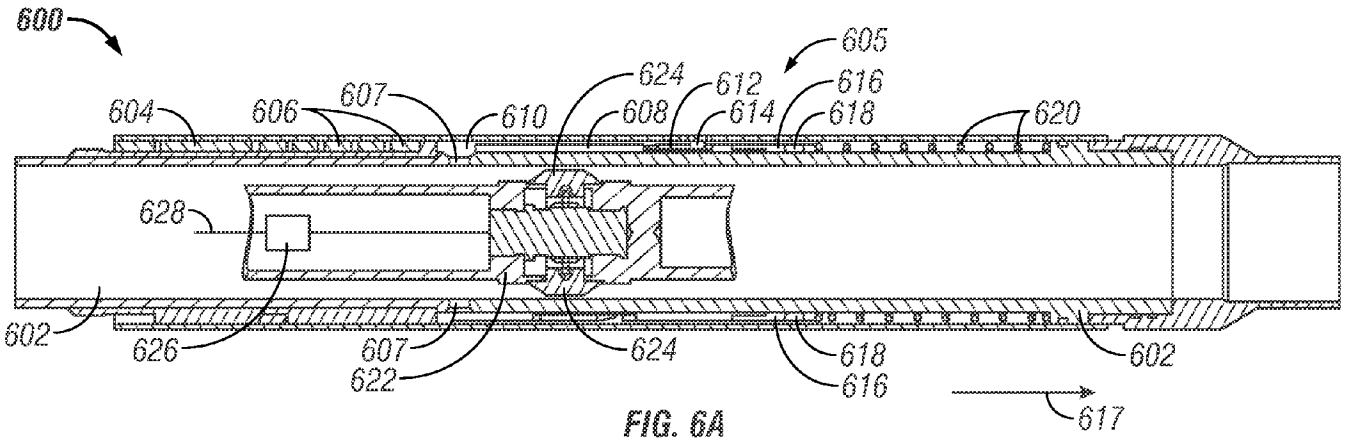
FIG. 6A shows a sectional side view of an adjustable flow control device with a magnetic latching device for adjusting flow through the flow control device in a first position according to one embodiment the disclosure.

In another embodiment, an electromagnetic and/or electrical mechanical device may be used to adjust the position of a flow control device, wherein a wireline or slickline may communicate command signals and power to control the fluid flow into the tubular. FIG. 6A is a sectional view of an embodiment of a tubular 602 and adjustable flow control device 600 in a first position. As depicted, the adjustable flow control device 600 is shown prior to shifting or adjusting the flow path into the tubular 602. The adjustable flow control device 600 includes a multi-channel flow member 604 that contains a series of stages 606. The stages 606 enable flow of fluids through a flow port 607 into the tubular 602. In an embodiment, a plurality of flow ports 607 are positioned circumferentially about the tubular 600. A setting device 605 includes a rotationally indexed member 608 with a recessed portion 610 that selectively exposes one the flow ports 607. The rotationally indexed member 608 includes a track 612 and pin 614 that cooperatively control movement of the rotationally indexed member 608. In an aspect a plurality of pins 614 may be positioned within the track 612 to ensure stability during rotational movement. In aspects, the track 612 is a patterned opening in the member that enables rotational and axial movement to adjust flow of fluid through the adjustable flow control device 600.

The setting device 605 also includes a biasing member 620 and guide sleeve 616, each located outside of tubular 602. The guide sleeve 616 is coupled to the rotationally indexed member 608 for axial movement 617 as well as independent rotational movement of the components relative to one another. A magnetic member 618 is positioned in the guide sleeve 616 to enable a magnetic coupling to components inside the tubular 602. In one aspect, a plurality of magnetic members 618 may be circumferentially positioned in the sleeve 616. As illustrated, the guide sleeve 616 is also coupled to a biasing member 620, such as a spring, that resists axial movement 617 when compressed. The biasing member 620 is secured to the tubular 602 on the end opposite the guide sleeve 616. As shown, the pin 614 is positioned near a first end of the track 612 (or downhole axial extremity). In other aspects, the guide sleeve 616 may be metallic or magnetized, thereby providing a coupling force for a magnet inside the tubular 600.

An intervention string 622 may be used to convey a magnet assembly 624 downhole within the tubular 600. The magnet assembly 624 may include a suitable electromagnet configured to use electric current to generate a magnetic field. The magnet assembly 624 may generate a magnetic field to cause a coupling with the metallic member(s) 618. Current is supplied to the magnet assembly 624 by a suitable power source 626, which may be positioned in, on or adjacent to a wireline or coil tubing. The magnet assembly 624 may be selectively powered as the intervention string 622 travels axially in the direction 617 within the tubular 600 to cause movement of the guide sleeve 616. For example, the magnetic assembly 624 may generate a magnetic field to enable a coupling to the magnetic member(s) 618 as the string 622 moves axially 617 downhole, thereby causing the guide sleeve 616 to move axially 617. The magnetic coupling between the magnet assembly 624 and the magnetic members 618 is of a sufficient strength to maintain the coupling to overcome the spring force of biasing member 620 as the guide sleeve 616 moves axially 617. In an aspect, the metallic member(s) 614 may be a magnet to provide sufficient force in a coupling between the member and magnet assembly 624. The magnet assembly 624 may include a plurality of electromagnets spaced circumferentially about the assembly, wherein each electromagnet is configured to couple to a corresponding metallic member 614. As depicted, the wireline components and magnet assembly 624 may be used to move the guide sleeve 616 and rotationally indexed member 608 axially 617. Further, the axial 617 movement of the magnet assembly 624, while magnetically coupled to the guide sleeve 616, causes rotational movement of the rotationally indexed member 608, thereby adjusting the flow path through the multi-channel flow member 604.

It should be noted that the components positioned outside of tubular 602 (FIGS. 6A-6C), including the adjustable flow control device 600, are substantially similar to those shown in FIGS. 3A-5B. Specifically, in aspects, the illustration of FIGS. 6A, 6B and 6C correspond to that of FIGS. 3A, 4A and 5A. The illustrated mechanisms show different devices or tools located inside the tubular to adjust the adjustable flow control devices. In other embodiments, the components, including the multi-channel flow member 604 and rotationally indexed member 608, may include different application-specific configurations and components depending on cost, performance and other considerations. In addition, the power source 626 may also include one or more sensor packages, including but not limited to, sensors for making measurements relating to flow rate, fluid composition, fluid density, temperature, pressure, water cut, oil-gas ratio and vibration. In an embodiment, the measurements are processed by a processor using a program and a memory, and may utilize selected parameters based on the measurements to alter the position and flow through the adjustable flow control device 602.

Figure 6B:
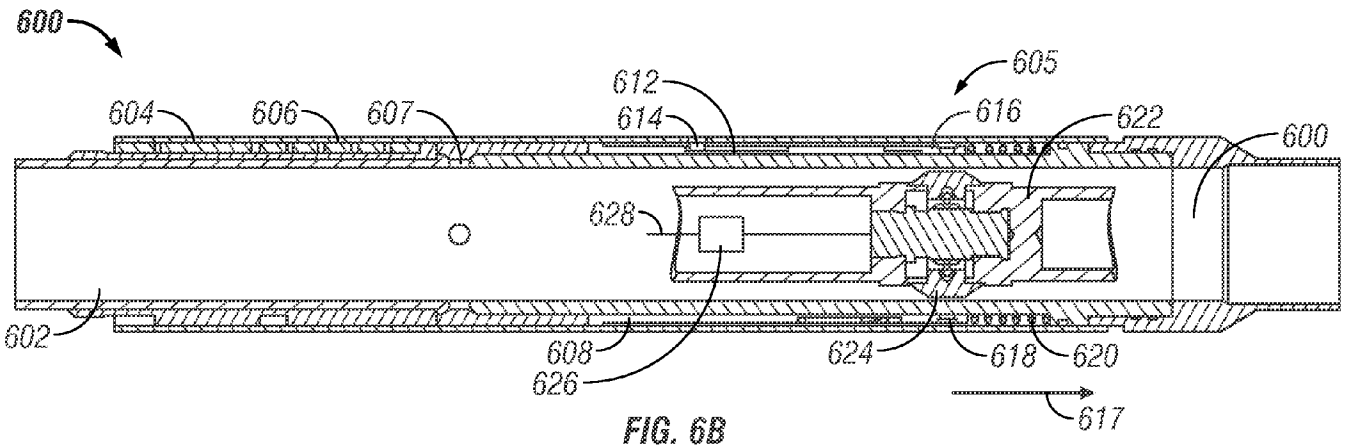
FIG. 6B shows a sectional view of the adjustable flow control device of FIG. 6A in a second position according to one embodiment the disclosure.

FIG. 6B is a sectional view of the tubular 602 and adjustable flow control device 600, as shown in FIG. 6A, in a second position. As shown, the biasing member 620 is compressed between the guide sleeve 616 and the tubular 600. Relative to the position in FIG. 6A, the rotationally indexed member 608 has shifted axially 617 in a downhole direction, wherein the pin 614 is positioned near a second end of the track 612 (or uphole axial extremity). The rotationally indexed member 608 rotates while moving axially between the first position (FIG. 6A) and second position (FIG. 6B). As depicted, the magnetic assembly 624 is coupled to the metallic members 618. The magnetic coupling provides a force in direction 617 that overcomes the spring force of the biasing member 620 to compress the member. The adjustable flow control device 600 is shown in the process of adjusting the flow path into the tubular 602. In an aspect, the second illustrated position is approximately halfway between a first flow channel position (position one, FIG. 6A) and a second flow channel position (position three, FIG. 6C below).

Figure 6C:
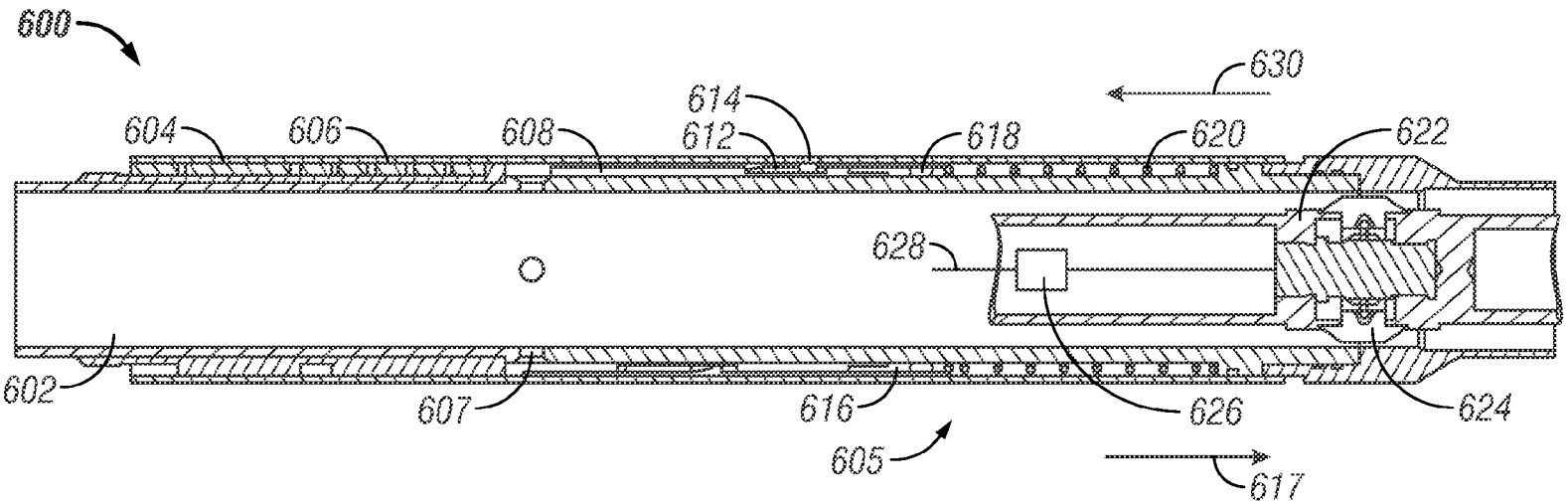
FIG. 6C shows a sectional view of the adjustable flow control device of FIG. 6A in a third position according to one embodiment the disclosure.

FIG. 6C, a sectional view of the tubular 602 and adjustable flow control device 600 that shows the adjustable flow control device of FIGS. 6A and 6B, in a third position. The magnet assembly 624 is disabled, thereby removing the magnetic field and decoupling the assembly from the metallic members 618. Accordingly, the guide sleeve 616 retracts in direction 630, as it is pushed by the force of biasing member 620. As the rotationally indexed member 608 shifts axially 630 in an uphole direction, the pin 614 is positioned near the first end of the track 612 (or downhole axial extremity). As shown, the rotationally indexed member 608 and the adjustable flow control device 600 is in a second flow channel position, thereby exposing flow port 607 in recessed portion 610 (not shown). In an aspect, four flow channels or paths are provided in multi-channel flow member 604, wherein a selected channel may be in fluid communication with one or more flow ports 607 in the tubular 602. Accordingly, the positions illustrated in FIGS. 6A-6C show the adjustable flow control device 600 shifting from a first flow channel position to a second flow channel position. In an embodiment, the first flow channel position of FIG. 6A corresponds to the position shown in FIG. 3A. Further, the second flow channel position of FIG. 6C may correspond to the position shown in FIG. 5A. The illustrated magnetic assembly 624 provides an apparatus for adjusting fluid flow into the tubular 602 locally, using a processor and program, or by a remote user, wherein the apparatus includes fewer moving parts. The processor and/or program may be located downhole or at the surface, depending on application needs and other constraints.

It should be understood that FIGS. 1-6C are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A method of producing fluids from a wellbore that includes a production zone having a flow control device installed in the wellbore for controlling flow of fluid between a formation and the wellbore, the method comprising:

providing a tool having a sensor configured to provide measurements relating to a downhole property of interest, wherein the tool is configured to adjust flow of the fluid through the flow control device installed in the wellbore;

conveying the tool from a surface into the wellbore at least partially within the flow control device;

determining the downhole property of interest using the sensor; and adjusting the flow through the flow control device with the tool at least in part in response to the determined downhole property of interest.

2. The method of claim 1, wherein the property of interest relates to a flow of the fluid through the flow control device.

3. The method of claim 2, further comprising:

determining flow of the fluid through the flow control device after adjusting the flow control device; and readjusting the flow control device when the determined flow is above a desired value.

4. The method of claim 1, wherein the property of interest is one of an indication of water content or gas content in the fluid.

5. The method of claim 1, wherein determining the property of interest and adjusting the flow control device are performed without tripping the tool out of wellbore.

6. The method of claim 1, wherein conveying the tool includes conveying the tool using one of a wireline and a tubular member.

7. The method of claim 1, wherein the sensor is selected from the group consisting of: flow meter; resistivity sensor; acoustic sensor, pressure sensor, temperature sensor, nuclear magnetic resonance sensor, a sensor for determining a chemical property of the fluid, a sensor for determining a physical property of the fluid; and a sensor for determining an optical property of the fluid.

8. The method of claim 1, wherein adjusting the flow control device comprises:

coupling the tool to a movable member of the flow control device; and moving the tool inside the flow control device to move the movable member to adjust the flow control device.

9. The method of claim 8, wherein coupling the tool to the movable member of the flow control device comprises one selected from the group consisting of: mechanically coupling the movable member to a latching element in the tool; and magnetically coupling a magnetic member associated with the movable member of the flow control device by a magnet in the tool.

10. The method of claim 1, wherein adjusting the flow control device includes one selected from the group consisting of: setting the flow control device to selected one of a plurality of predefined settings; blocking a partial flow of the fluid from an outlet region of the flow control device.

11. An apparatus for controlling fluid flow between a formation and a wellbore, comprising:

a tool configured to be conveyed from a surface into a wellbore at least partially within a flow control device installed in the wellbore, the tool including:

at least one sensor for estimating a property of interest downhole; and a latching device configured to couple to the flow control device in the wellbore to alter flow of fluid through the flow control device.

12. The apparatus of claim 11, wherein the latching device includes a coupling device that is one selected from the group consisting of: a mechanical coupling device configured to latch on to a mechanical moving element of the flow control device; and a magnetic coupling device configured to magnetically couple to a magnetic element in the flow control device.

13. The apparatus of claim 11, wherein the tool is conveyable in the wellbore by one of a wireline and a tubular.

14. The apparatus of claim 11, further comprising a controller configured to process sensor signals to provide an estimate of the property of interest.

15. The apparatus of claim 14, wherein the controller is located at one selected from the group consisting of: at a surface location; in the tool; and partially in the tool and partially at the surface.

16. The apparatus of claim 11, wherein the sensor is selected from the group consisting of a: flow meter; resistivity sensor; acoustic sensor, pressure sensor, temperature sensor, nuclear magnetic resonance sensor, a sensor for determining a chemical property of the fluid, a sensor for determining a physical property of the fluid; and a sensor for determining an optical property of the fluid.

17. The apparatus of claim 11, wherein the tool is configured to determine the property of interest and adjust the flow control device without tripping the tool out of the wellbore.

18. The apparatus of claim 11, further comprising one or more sensors that provide measurement for determining location of the tool in the wellbore.

19. The apparatus of claim 11, wherein the latching device includes an electromagnet and a circuitry for activating the electromagnet when the tool is in the wellbore.

20. A method of controlling flow of a fluid from formation into a wellbore, comprising:

placing a flow control device at a selected location in the wellbore, the flow control device including a flow region and a setting device for adjusting a flow of the fluid through the flow region;

conveying a tool from a surface into the wellbore after the flow control device has been placed at the selected location, the tool being configured to move inside the flow control device, the tool including (i) a sensor configured to provide measurements relating to a downhole property of interest, and (ii) a latching device configured to couple to the setting device of the flow control device;

determining the property of interest using measurements taken by the sensor in the wellbore; and coupling the latching device in the tool to the setting device in the flow control device and moving the setting device to adjust flow through the flow control device in response to the determined value of the property of interest during a single trip of the tool in the wellbore.

* * * * *